US009617836B2

(12) United States Patent
Garcia et al.

(10) Patent No.: US 9,617,836 B2
(45) Date of Patent: Apr. 11, 2017

(54) PASSIVE IN-FLOW CONTROL DEVICES AND METHODS FOR USING SAME

(71) Applicant: Baker Hughes Incorporated, Houston, TX (US)

(72) Inventors: Gonzalo A. Garcia, Katy, TX (US); Peter J. Kidd, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 315 days.

(21) Appl. No.: 14/327,342

(22) Filed: Jul. 9, 2014

(65) Prior Publication Data

US 2015/0053419 A1 Feb. 26, 2015

Related U.S. Application Data

(60) Provisional application No. 61/869,602, filed on Aug. 23, 2013.

(51) Int. Cl.

| | |
|---|---|
| ***E21B 43/12*** | (2006.01) |
| ***E21B 34/08*** | (2006.01) |
| ***E21B 43/14*** | (2006.01) |

(52) U.S. Cl.

CPC ..... *E21B 43/12* (2013.01); *E21B 34/08* (2013.01); *E21B 43/14* (2013.01)

(58) Field of Classification Search

CPC ..... E21B 34/08; E21B 43/12; E21B 43/14; E21B 43/20; E21B 34/06

See application file for complete search history.

(56) References Cited

U.S. PATENT DOCUMENTS

| | | | |
|---|---|---|---|
| 6,112,817 | A | 9/2000 | Voll et al. |
| 6,405,800 | B1 | 6/2002 | Walker et al. |
| 7,409,999 | B2 | 8/2008 | Henriksen et al. |
| 7,591,312 | B2 | 9/2009 | Johnson et al. |
| 7,757,761 | B2 | 7/2010 | Augustine |
| 7,775,283 | B2 | 8/2010 | Coronado et al. |
| 7,823,645 | B2 | 11/2010 | Henriksen et al. |
| 7,909,088 | B2 | 3/2011 | O'Malley et al. |
| 7,913,765 | B2 | 3/2011 | Crow et al. |
| 7,954,546 | B2 | 6/2011 | Kim et al. |
| 7,980,265 | B2 | 7/2011 | Holmes et al. |
| 7,992,637 | B2 | 8/2011 | Garcia |
| 8,069,921 | B2 | 12/2011 | Garcia et al. |
| 8,096,351 | B2 | 1/2012 | Peterson et al. |

(Continued)

FOREIGN PATENT DOCUMENTS

WO 2013119472 A1 8/2013

OTHER PUBLICATIONS

PCT/US2014/046168—International Search Report dated Oct. 10, 2014.

*Primary Examiner* — Blake Michener
*Assistant Examiner* — Manuel C Portocarrero
(74) *Attorney, Agent, or Firm* — Mossman, Kumar & Tyler PC

(57) ABSTRACT

An apparatus for controlling a flow of a fluid between a wellbore tubular and a wellbore annulus may include an inflow control device configured to generate a predetermined pressure drop in the flowing fluid; a plurality of particulate control devices conveying the fluid to the inflow control device; and at least one fluid coupling conveying the fluid from at least one of the particulate control devices to the inflow control device.

15 Claims, 3 Drawing Sheets

(56) References Cited

U.S. PATENT DOCUMENTS

| | | | | |
|---|---|---|---|---|
| 8,104,538 | B2 | 1/2012 | Richard et al. | |
| 8,151,881 | B2 | 4/2012 | Johnson et al. | |
| 8,210,258 | B2 | 7/2012 | O'Malley et al. | |
| 8,312,931 | B2 | 11/2012 | Xu et al. | |
| 8,342,245 | B2 | 1/2013 | Richard et al. | |
| 8,403,038 | B2 | 3/2013 | Russell et al. | |
| 8,403,061 | B2 | 3/2013 | Russell et al. | |
| 8,424,609 | B2 | 4/2013 | Duphorne et al. | |
| 8,443,888 | B2 | 5/2013 | Coronado | |
| 8,443,892 | B2 | 5/2013 | Richard et al. | |
| 8,469,105 | B2 | 6/2013 | O'Malley et al. | |
| 8,469,107 | B2 | 6/2013 | O'Malley et al. | |
| 8,527,100 | B2 | 9/2013 | Russell et al. | |
| 8,544,548 | B2 | 10/2013 | Coronado et al. | |
| 8,550,166 | B2 | 10/2013 | Xu et al. | |
| 8,646,535 | B2 | 2/2014 | Xu et al. | |
| 8,678,350 | B2 | 3/2014 | Coull | |
| 2003/0000699 | A1 | 1/2003 | Hailey et al. | |
| 2009/0095471 | A1* | 4/2009 | Guignard | E21B 34/14 166/278 |
| 2009/0095484 | A1* | 4/2009 | Huang | E21B 34/08 166/319 |
| 2010/0155064 | A1 | 6/2010 | Nutley et al. | |
| 2010/0263871 | A1 | 10/2010 | Xu et al. | |
| 2013/0186626 | A1* | 7/2013 | Aitken | E21B 34/06 166/285 |
| 2013/0213664 | A1 | 8/2013 | Russell et al. | |
| 2014/0216754 | A1 | 8/2014 | Richard et al. | |

* cited by examiner

PASSIVE IN-FLOW CONTROL DEVICES AND METHODS FOR USING SAME

CROSS-REFERENCE TO RELATED APPLICATIONS

This application claims priority from U.S. Provisional Application Ser. No. 61/869,602 filed Aug. 23, 2013, the entire disclosure of which is incorporated herein by reference in its entirety.

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to control drainage along the production zone or zones to reduce undesirable conditions such as an invasive gas cone, water cone, and/or harmful flow patterns.

The present disclosure addresses these and other needs of the prior art.

SUMMARY OF THE DISCLOSURE

In aspects, the present disclosure provides an apparatus for controlling a flow of a fluid between a wellbore tubular and a wellbore annulus. The apparatus may include an inflow control device configured to generate a predetermined pressure drop in the flowing fluid; a plurality of particulate control devices conveying the fluid to the inflow control device; and at least one fluid coupling conveying the fluid from at least one of the particulate control devices to the inflow control device.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
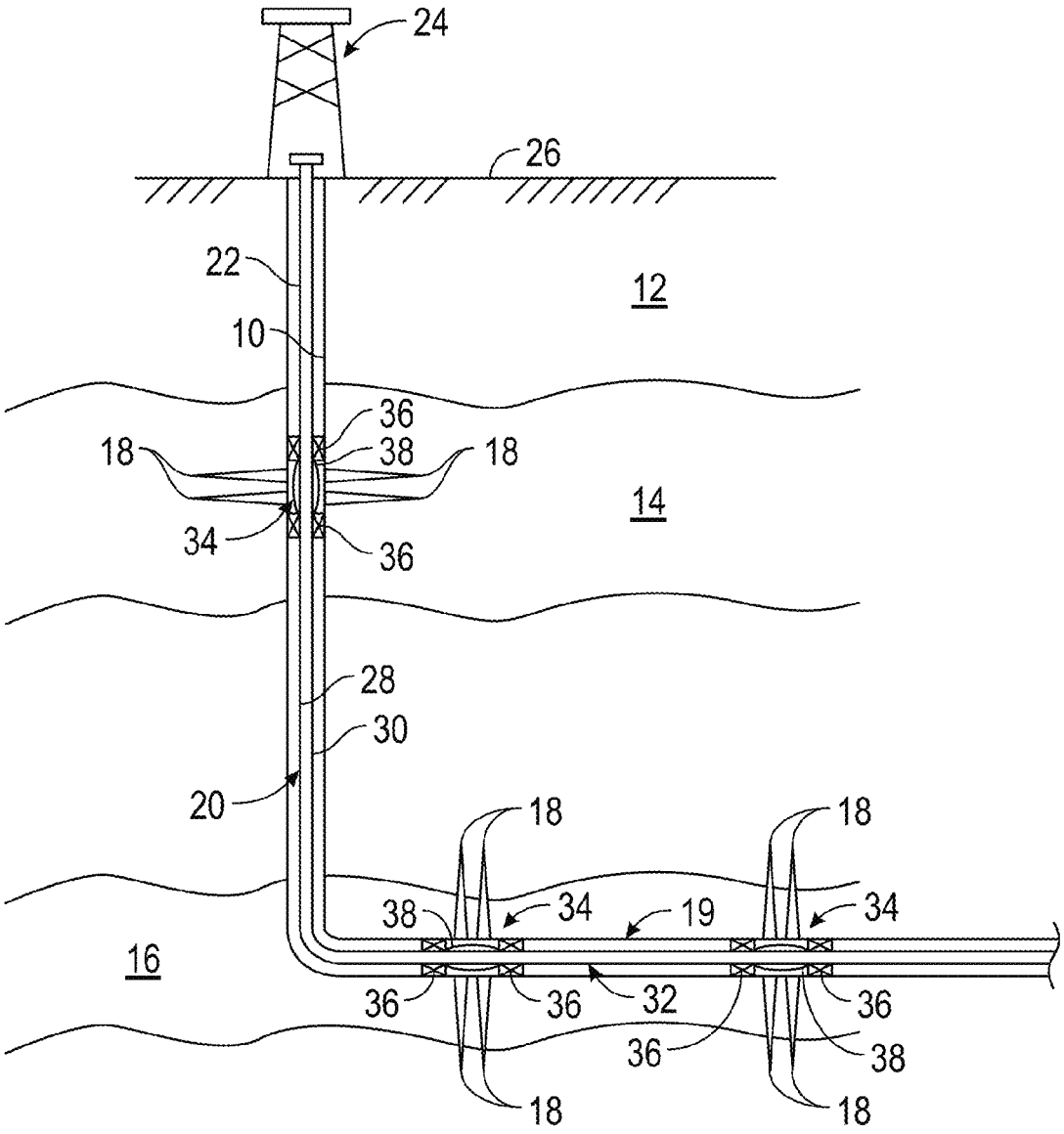
FIG. 1 is a schematic elevation view of an exemplary multi-zonal wellbore and production assembly which incorporates an inflow control system in accordance with one embodiment of the present disclosure.

The present disclosure relates to devices and methods for controlling production of a subsurface fluid. In several embodiments, the devices describe herein may be used with a hydrocarbon producing well. In other embodiments, the devices and related methods may be used in geothermal applications, ground water applications, etc. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

In aspects, the present disclosure may be used in low production horizontal wells to address the reservoir heterogenities and unfavorable mobility ratios to cause even influx along a wellbore, which can promote more oil and less water production along the well life cycle. In some arrangements, embodiments of the present disclosure form a fluid connection between multiple screens (particulate control devices) and one inflow control device that generates a specified pressure drop. A connector that provides an annular flow space may be used to serially connect these screens. Thus, the flow rate to the inflow device can be increased to allow the inflow control device to control influx by generating the desired pressure drop. Embodiments of the present disclosure may be used in a standalone or gravel pack application. The teachings of the present disclosure may be used in any number of situations, e.g., high water production wells or low production in carbonates.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flow bore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production nipple 34 is isolated within the wellbore 10 by a pair of packer devices 36. Although only a few production nipples 34 are shown in FIG. 1, there may, in fact, be a large number of such nipples arranged in serial fashion along the horizontal portion 32.

Each production nipple 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
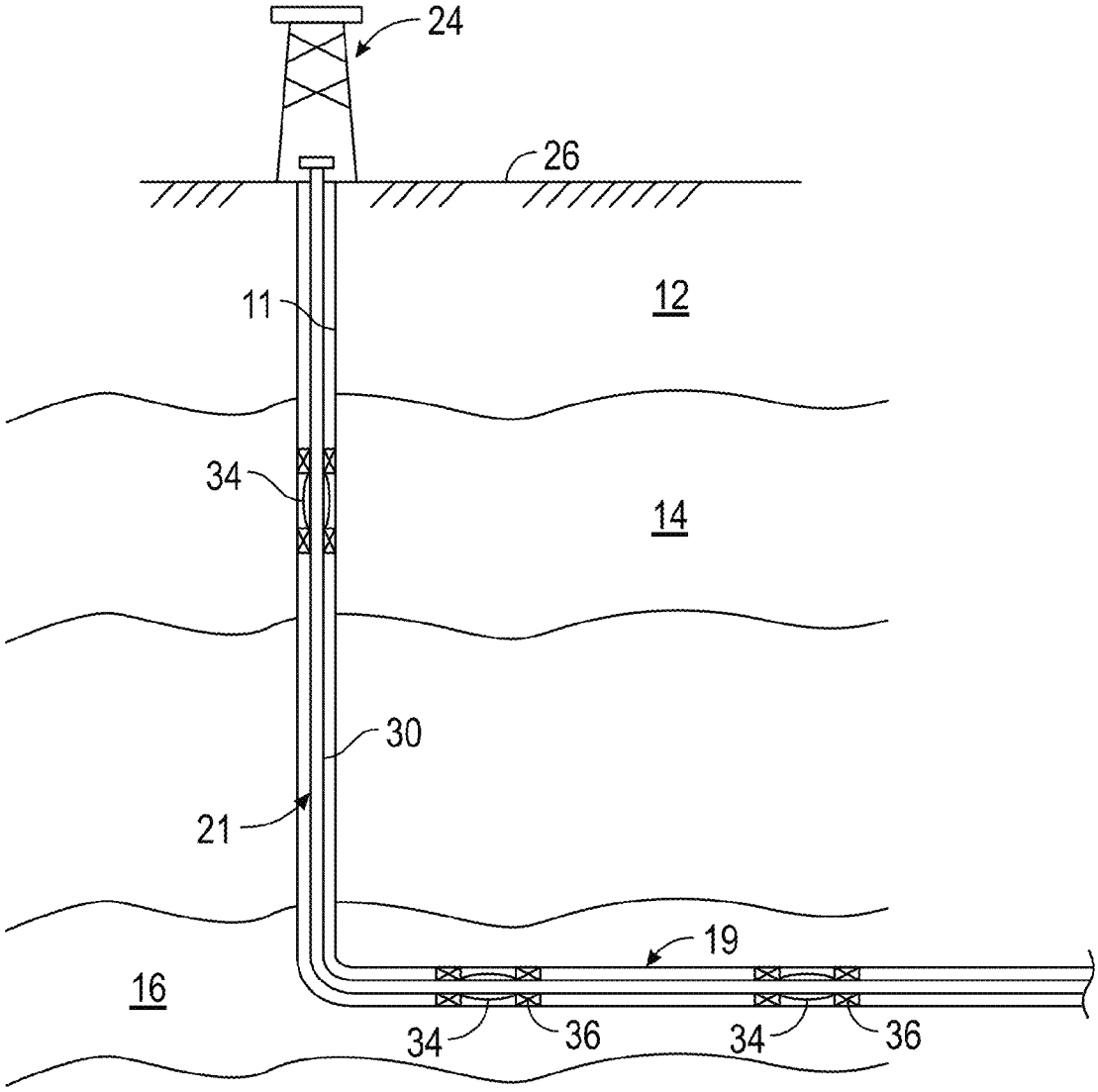
FIG. 2 is a schematic elevation view of an exemplary open hole production assembly which incorporates an inflow control system in accordance with one embodiment of the present disclosure.

FIG. 2 illustrates an exemplary open hole wellbore 11 wherein the production devices of the present disclosure may be used. Construction and operation of the open hole wellbore 11 is similar in most respects to the wellbore 10 (FIG. 1) described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and the packers 36 may be used to separate the production nipples. However, there may be some situations where the packers 36 are omitted. The nature of the production control device is such that the fluid flow is directed from the formation 16 directly to the nearest production nipple 34.

Figure 3:
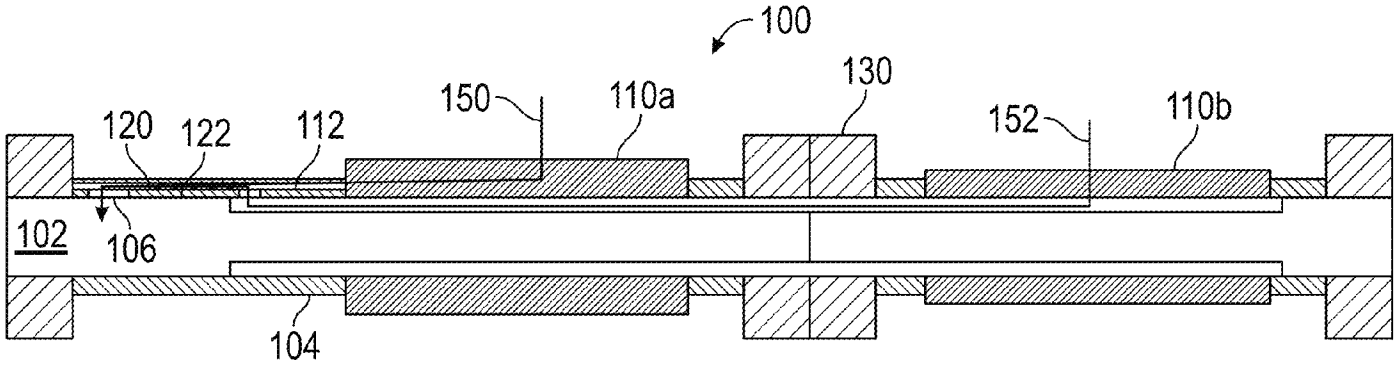
FIG. 3 is a sectional view of an exemplary production control device made in accordance with one embodiment of the present disclosure.

Referring now to FIG. 3, there is shown one embodiment of a production or injection control device 100 for controlling the flow of fluids between a reservoir and a flow bore 102 of a tubular 104 along a production string (e.g., tubing string 22 of FIG. 1). The control devices 100 may be distributed along a section of a production well to provide fluid control at multiple locations. This can be useful, for example, to impose a desired drainage or production influx pattern. By appropriately configuring the production control devices 100, a well owner can increase the likelihood that an oil or gas bearing reservoir will drain efficiently. This drainage pattern may include equal drainage from all zones or individualized and different drainage rates for one or more production zones. During injection operations, wherein a fluid such as water or steam is directed into the reservoir, the devices 100 may be used to distribute the injected fluid in a desired manner. Exemplary production control devices are discussed herein below.

In one embodiment, the production control device 100 includes particulate control devices 110*a,b* for reducing the amount and size of particulates entrained in the fluids and an inflow control device 120 that control overall drainage rate from the formation. The particulate control devices 110*a,b* can include known devices such as sand screens and associated gravel packs. In embodiments, the in-flow control device 120 utilizes flow channels, orifices, and/or other geometries that control in-flow rate and/or the type of fluids entering the flow bore 102 of a tubular 104 via one or more flow bore openings 106. Illustrative embodiments are described below.

The in-flow control device 120 may have flow passages 122 that may include channels, orifices bores, annular spaces and/or hybrid geometry, that are constructed to generate a predetermined pressure differential across the in-flow device 120. By hybrid, it is meant that a give flow passage may incorporate two or more different geometries (e.g., shape, dimensions, etc.). By predetermined, it is meant that the passage generates a pressure drop greater than the pressure drop that would naturally occur with fluid flowing directly across the in-flow control device 120. Additionally, by predetermined it is meant that the pressure drop has been determined by first estimating a pressure parameter relating to a formation fluid or other subsurface fluid. The flow passage 122 is configured to convey fluid between the particulate control devices 110*a,b* and the flow bore 102. It should be understood that the flow passage 122 may utilize helical channels, radial channels, chambers, orifices, circular channels, etc.

The particulate control devices 110 *a, b* may be serially aligned along a section of the tubing string 22. By serially aligned, it is meant aligned end-to-end. The particulate control devices 110 all feed into one in-flow control device 120. The particulate control device 110*a* immediately adjacent to the inflow control device 120 may use an annular flow space 112 for fluid communication with the inflow control device 120. By immediately adjacent, it is meant that there are no other particulate control devices separating the particulate control device 110*a* and the inflow control device 120. For the remote particulate control device 110*b*, a fluid coupling 130 may be used to provide fluid communication with the inflow control device 120. A "coupling" as used herein refers to an assembly of walls and passages that interconnect at least two particulate control devices.

Figure 4:
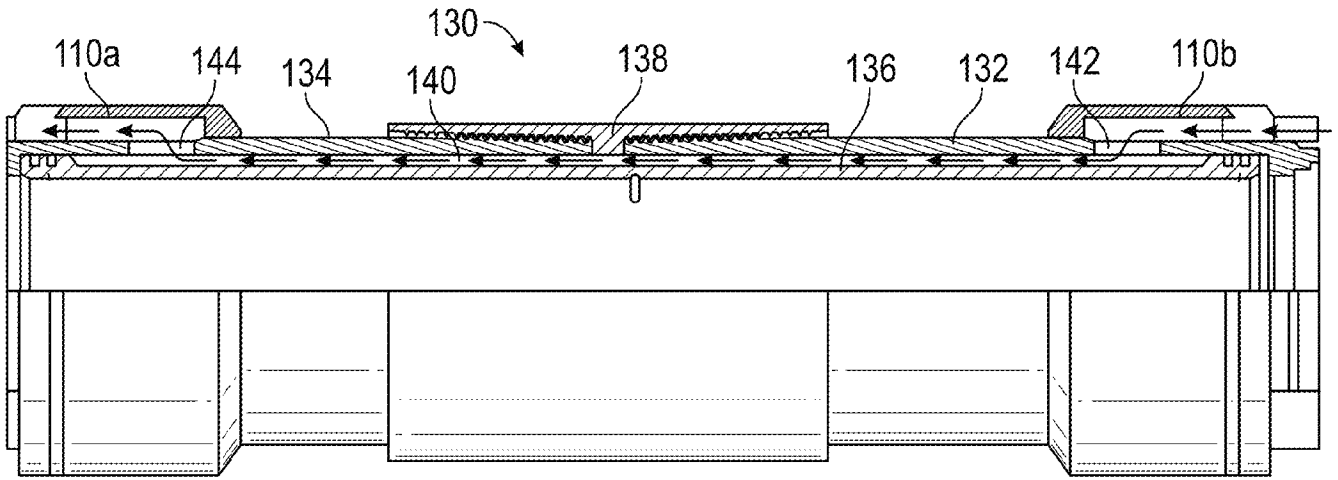
FIG. 4 is schematic illustration of a fluid coupling for use with the FIG. 3 embodiment.

Referring now to FIG. 4, there is shown one embodiment of a fluid coupling 130. The fluid coupling 130 may include a first sub 132, a second sub 134, a mandrel 136, and a connector 138. The first sub 132 may be connected to or be formed a part of the assembly of the remote particulate control device 110*b*. The second sub 134 may be connected to or be formed a part of the assembly of the adjacent particulate control device 110*a*. The subs 132, 134 may be a joint, tube, sleeve or other tubular. The mandrel 136 may also be a tubular member that is disposed within the subs 132, 134.

The outer surface of the mandrel 136 and the inner surfaces of the subs 132, 134 are dimensioned to form an annular flow space 140. It should be noted that the annular flow space 140 provides an independent flow path to the inflow control device 120 that is hydraulically independent of the flow path 112 that connects the adjacent particulate control device 110*a* to the inflow control device 120. Because the flow paths 112, 140 are hydraulically parallel, the fluids in the flow paths 112, 140 only comingle at the inlet to the inflow control device. It should be noted that the flow paths 112, 140 are also geometrically parallel in that they are aligned next to one another and both span at least a portion of a common distance. The sub 132 may include one or more openings 142 that provide fluid communication between the annular flow space 140 and the remote particulate control device 110*b*. The sub 134 may include one or more openings 144 that provide fluid communication between the annular flow space 140 and the inflow control device 110 (FIG. 3). The connector 138 may be used to connect the subs 132, 134 using conventional mechanisms such as threads.

While two particulate control devices 110 are shown in FIG. 3, it should be understood that the production control device 100 may include three or more particulate control devices 110. Thus, the fluid coupling 130 may be used to convey fluid from all these particulate control devices 110 to the inflow control device 120. For example, the mandrel 136 may be axially lengthened to internally span across a multiple number of particulate control devices 110.

Referring now to FIGS. 3 and 4, during one exemplary use, a first fluid stream 150 (liquid, gas, steam or mixture) flows into the particulate control device 110*a* and a second fluid stream 152 (liquid, gas, steam or mixture) flows into the particulate control device 110*b*. The first fluid stream 150 flows to the inflow control device 120 via the flow space 112. The second fluid stream 152 flows through the opening 142 into the flow space 140. Thereafter, the second fluid stream 152 flows through the opening 144 and to the inflow control device 120. Thus, the inflow control device 120 receives fluid streams from both of the particulate control devices 110*a,b*. It should be noted that the two fluid streams comingle at only an inlet to the inflow control device and exit as a comingled fluid stream via the inflow control device opening. The inflow control device 120 generates a predetermined pressure drop in the fluid streams 150, 152, which then assist in controlling fluid inflow (e.g., increasing liquid hydrocarbon production and reduce water and/or gas production).

Accordingly, it should be appreciated that embodiment of the present disclosure include an apparatus for controlling a flow of a fluid between a wellbore tubular and a wellbore annulus. The apparatus may include an inflow control device configured to generate a predetermined pressure drop in the flowing fluid, the inflow control device having an opening in fluid communication with a bore of the wellbore tubular; a first particulate control device forming a first fluid stream conveyed to the inflow control device; at least one additional particulate control device serially aligned with the first particulate control device, the at least one additional particulate control device forming a second fluid stream conveyed to the inflow control device; and at least one fluid coupling conveying the second fluid stream from the at least one additional particulate control device to the inflow control device, wherein the first fluid stream and the second fluid stream comingle at only an inlet to the inflow control device and exit as a comingled fluid stream via the inflow control device opening.

It should also be appreciated that embodiments of the present disclosure include a method for controlling fluid flow between a wellbore tubular and a wellbore annulus. The method may include receiving fluid from the wellbore annulus into a first particulate control device; conveying the fluid received from the first particulate control device as a first fluid stream to an inflow control device; receiving fluid from the wellbore annulus into at least one additional particulate control device; conveying the fluid received from the at least one additional particulate control device as a second fluid stream to the inflow control device; and generating a predetermined pressure differential in the comingled first and second fluid streams flowing through the inflow control device.

Embodiments of the present disclosure also include an apparatus that includes an inflow control device having a flow passage configured to generate a predetermined pressure drop in the flowing fluid, the inflow control device having an opening in fluid communication with a bore of the wellbore tubular; an immediately adjacent particulate control device conveying a first fluid stream to the inflow control device; and a fluid coupling connecting the immediately adjacent particulate control device to at least one additional particulate control device. The fluid coupling may include a first sub axially aligned with a second sub; a connector connecting the first sub to the second sub; and a mandrel disposed within the first sub and the second sub, wherein an outer surface of the mandrel and inner surfaces of the first and the second sub are dimensioned to form an annular flow space that is geometrically parallel to the flow path, wherein the annular flow passage conveys a second fluid stream from the at least one additional particulate control devices to the inflow control device, wherein the first fluid stream and the second fluid stream comingle at only an inlet to the inflow control device and exit as a comingled fluid stream via the inflow control device opening.

While the teachings of the present disclosure may be applied to a variety of situations, certain embodiments of the present disclosure may be useful in controlling inflow patterns in low production situations (e.g., less than one hundred barrels of flow per day). For very low permeability it is important to reduce the pressure drop due to convergence flow, longer screen jacket length or multiple screen joint connected will mitigate convergence flow issues.

For the sake of clarity and brevity, descriptions of most threaded connections between tubular elements, elastomeric seals, such as o-rings, and other well-understood techniques are omitted in the above description. Further, terms such as "slot," "passages," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid between a wellbore tubular and a wellbore annulus, comprising:

an inflow control device configured to generate a predetermined pressure drop in the flowing fluid, the inflow control device having an opening in fluid communication with a bore of the wellbore tubular;

a first particulate control device forming a first fluid stream conveyed to the inflow control device;

at least one additional particulate control device serially aligned with the first particulate control device, the at least one additional particulate control device forming a second fluid stream conveyed to the inflow control device; and at least one fluid coupling conveying the second fluid stream from the at least one additional particulate control device to the inflow control device, wherein the first fluid stream and the second fluid stream comingle at only an inlet to the inflow control device and exit as a comingled fluid stream via the inflow control device opening.

2. The apparatus of claim 1, wherein the fluid coupling includes:

a first sub axially aligned with a second sub;

a connector connecting the first sub to the second sub; and a mandrel disposed within the first sub and the second sub, wherein an outer surface of the mandrel and inner surfaces of the first and the second sub are dimensioned to form an annular flow space through which the second stream flows.

3. The apparatus of claim 2, wherein the first sub is connected to first particulate control device and the second sub is connected to the at least one additional particulate control device, and wherein the first sub and the second sub are interposed between the first particulate control device and the at least one additional particulate control device.

4. The apparatus of claim 3, wherein the annular flow space is hydraulically independent of a flow path that connects the first particulate control device to the inflow control device, the annular flow space and the flow path being geometrically parallel.

5. The apparatus of claim 3, wherein the second sub includes at least one opening that provides fluid communication between the annular flow space and the at least one additional particulate control device and the second sub includes at least one opening that provides fluid communication between the annular flow space and the inflow control device.

6. The apparatus of claim 1, wherein the first particulate control device and the at least one additional particulate control device are selected from at least one of: (i) a sand screen, and (ii) a gravel pack.

7. The apparatus of claim 1, wherein the inflow control device includes at least one of: (i) a flow channel, (ii) an orifice, (iii) a bore, (iv) an annular space, (v) a helical channel, (vi) a radial channel, and (vii) a chamber.

8. A method for controlling fluid flow between a wellbore tubular and a wellbore annulus, comprising:

receiving fluid from the wellbore annulus into a first particulate control device;

conveying the fluid received from the first particulate control device as a first fluid stream to an inflow control device;

receiving fluid from the wellbore annulus into at least one additional particulate control device;

conveying the fluid received from the at least one additional particulate control device as a second fluid stream to the inflow control device; and generating a predetermined pressure differential in the comingled first and second fluid streams flowing through the inflow control device.

9. The method of claim 8, wherein the fluid coupling includes:

a first sub axially aligned with a second sub;

a connector connecting the first sub to the second sub; and a mandrel disposed within the first sub and the second sub, wherein an outer surface of the mandrel and inner surfaces of the first and the second sub are dimensioned to form an annular flow space through which the second fluid stream flows.

10. The method of claim 9, wherein the first sub is connected to first particulate control device and the second sub is connected to the at least one additional particulate control device, and wherein the first sub and the second sub are interposed between the first particulate control device and the at least one additional particulate control device.

11. The method of claim 9, wherein the annular flow space is hydraulically independent of a flow path that connects the first particulate control device to the inflow control device, the annular flow space and the flow path being geometrically parallel.

12. An apparatus for controlling a flow of a fluid between a wellbore tubular and a wellbore annulus, comprising:

an inflow control device having a flow passage configured to generate a predetermined pressure drop in the flowing fluid, the inflow control device having an opening in fluid communication with a bore of the wellbore tubular;

an immediately adjacent particulate control device conveying a first fluid stream to the inflow control device via a flow path; and a fluid coupling connecting the immediately adjacent particulate control device to at least one additional particulate control device, the fluid coupling including:

a first sub axially aligned with a second sub;

a connector connecting the first sub to the second sub; and a mandrel disposed within the first sub and the second sub, wherein an outer surface of the mandrel and inner surfaces of the first and the second sub are dimensioned to form an annular flow space that is geometrically parallel to the flow path, wherein the annular flow space conveys a second fluid stream from the at least one additional particulate control devices to the inflow control device, wherein the first fluid stream and the second fluid stream comingle at only an inlet to the inflow control device and exit as a comingled fluid stream via the inflow control device opening.

13. The apparatus of claim 12, wherein the first sub is connected to first particulate control device and the second sub is connected to the at least one additional particulate control device, and wherein the first sub and the second sub are interposed between the first particulate control device and the at least one additional particulate control device.

14. The apparatus of claim 12, wherein the immediately adjacent particulate control device and the at least one additional particulate control device are selected from at least one of (i) a sand screen, and (ii) a gravel pack.

15. The apparatus of claim 12, wherein the passage of the inflow control device includes at least one of: (i) a flow channel, (ii) an orifice, (iii) a bore, (iv) an annular space, (v) a helical channel, (vi) a radial channel, and (vii) a chamber.

* * * * *